US010352021B2

(12) United States Patent
Matsuyama et al.

(10) Patent No.: US 10,352,021 B2
(45) Date of Patent: Jul. 16, 2019

(54) WORK EQUIPMENT CONTROL DEVICE AND WORK MACHINE

(71) Applicant: Komatsu Ltd., Tokyo (JP)

(72) Inventors: Toru Matsuyama, Tokyo (JP); Jin Kitajima, Tokyo (JP)

(73) Assignee: Komatsu Ltd., Tokyo (JP)

( * ) Notice: Subject to any disclaimer, the term of this patent is extended or adjusted under 35 U.S.C. 154(b) by 20 days.

(21) Appl. No.: 15/534,737

(22) PCT Filed: Nov. 29, 2016

(86) PCT No.: PCT/JP2016/085426
§ 371 (c)(1),
(2) Date: Jun. 9, 2017

(87) PCT Pub. No.: WO2017/104407
PCT Pub. Date: Jun. 22, 2017

(65) Prior Publication Data

US 2018/0148905 A1 May 31, 2018

(51) Int. Cl.

| | |
|---|---|
| ***E02F 3/32*** | (2006.01) |
| ***E02F 3/43*** | (2006.01) |
| ***E02F 9/20*** | (2006.01) |
| ***E02F 9/26*** | (2006.01) |

(52) U.S. Cl.
CPC ..... *E02F 3/439* (2013.01); *E02F 3/32* (2013.01); *E02F 3/437* (2013.01); *E02F 9/2033* (2013.01); *E02F 9/262* (2013.01); *E02F 9/265* (2013.01)

(58) Field of Classification Search
CPC ... E02F 3/439; E02F 3/32; E02F 3/437; E02F 9/2033; E02F 9/262; E02F 9/265
See application file for complete search history.

(56) References Cited

U.S. PATENT DOCUMENTS

| | | | | |
|---|---|---|---|---|
| 5,598,648 | A | 2/1997 | Moriya et al. | |
| 5,752,333 | A * | 5/1998 | Nakagawa | E02F 3/437 172/2 |
| 5,933,346 | A * | 8/1999 | Brabec | E02F 9/2025 340/684 |
| 6,076,029 | A | 6/2000 | Watanabe et al. | |
| 2007/0227137 | A1 | 10/2007 | Naruse | |

(Continued)

FOREIGN PATENT DOCUMENTS

| | | | |
|---|---|---|---|
| DE | 11 2008 003 479 | T5 | 1/2011 |
| JP | 03-066838 | A | 3/1991 |
| JP | 2002-167794 | A | 6/2002 |

(Continued)

*Primary Examiner* — Aaron L Troost
(74) *Attorney, Agent, or Firm* — Locke Lord LLP

(57) ABSTRACT

A work equipment control device includes a work equipment state specifying unit, a control reference specifying unit, a distance specifying unit, and a bucket control unit. The work equipment state specifying unit specifies a state of work equipment. The control reference specifying unit specifies a control reference of the work equipment. The distance specifying unit specifies a distance between the work equipment and the control reference. The bucket control unit generates a control command to drive a bucket such that the state of the work equipment is maintained when the distance between the work equipment and the control reference is less than a bucket control start threshold.

7 Claims, 8 Drawing Sheets

(56) References Cited

U.S. PATENT DOCUMENTS

| | | | |
|---|---|---|---|
| 2009/0159302 | A1 | 6/2009 | Koch et al. |
| 2016/0097184 | A1 | 4/2016 | Matsuyama et al. |

FOREIGN PATENT DOCUMENTS

| | | | |
|---|---|---|---|
| JP | 2010-203109 | A | 9/2010 |
| JP | 5654144 | B1 | 1/2015 |
| WO | 2005/108797 | A1 | 11/2005 |

* cited by examiner

WORK EQUIPMENT CONTROL DEVICE AND WORK MACHINE

CROSS REFERENCE TO RELATED APPLICATIONS

This application is related to co-pending application: "WORK EQUIPMENT CONTROL DEVICE AND WORK MACHINE" filed even date herewith in the names of Toru Matsuyama and Jin Kitajima as a national phase entry of PCT/JP2016/085429, which application is assigned to the assignee of the present application and is incorporated by reference herein.

TECHNICAL FIELD

The present invention relates to a work equipment control device and a work machine.

BACKGROUND ART

As disclosed in Patent Document 1, technology for controlling work equipment is known such that a bucket provided for a work machine is not intruded beyond a design surface indicating a target shape of an excavation object. As disclosed in Patent Document 2, technology for keeping an angle of a bucket constant to perform rectilinear excavation is known.

CITATION LIST

Patent Literature

[Patent Document 1]
Japanese Patent No. 5654144
[Patent Document 2]
Japanese Unexamined Patent Application, First Publication No. H03-66838

SUMMARY OF INVENTION

Technical Problem

According to the technology described in Patent Document 1, when the bucket is controlled so as to be not intruded beyond the design surface, an operator needs to manipulate a manipulator to control an angle of the bucket to be a proper angle when finishing excavation of the design surface. According to the technology described in Patent Document 2, the angle of the bucket can be kept constant, but a switching operation is required to keep the angle of the bucket constant.

The purpose of an aspect of the present invention is to provide a work equipment control device capable of maintaining a constant excavating posture during excavation work without explicit manipulation from an operator, and a work machine provided therewith.

Solution to Problem

According to a first aspect of the present invention, a control device is a work equipment control device for controlling a work machine provided with work equipment including a bucket, and the control device includes: a work equipment state specifying unit configured to specify a state of the work equipment; a control reference specifying unit configured to specify a control reference of the work equipment; a distance specifying unit configured to specify a distance between the work equipment and the control reference; and a bucket control unit configured to generate a control command to drive the bucket such that the state of the work equipment is maintained when the distance between the work equipment and the control reference is less than a bucket control start threshold.

According to a second aspect of the present invention, a work machine includes: work equipment including a bucket, and the work equipment control device according to the first aspect.

Advantageous Effects of Invention

According to at least one of the above aspects, the work equipment control device can maintain a constant angle of the bucket during excavation work without explicit manipulation from an operator.

DESCRIPTION OF EMBODIMENTS

<First Embodiment>

Hereinafter, an embodiment will be described with reference to the drawings.

<<Hydraulic Excavator>>

Figure 1:
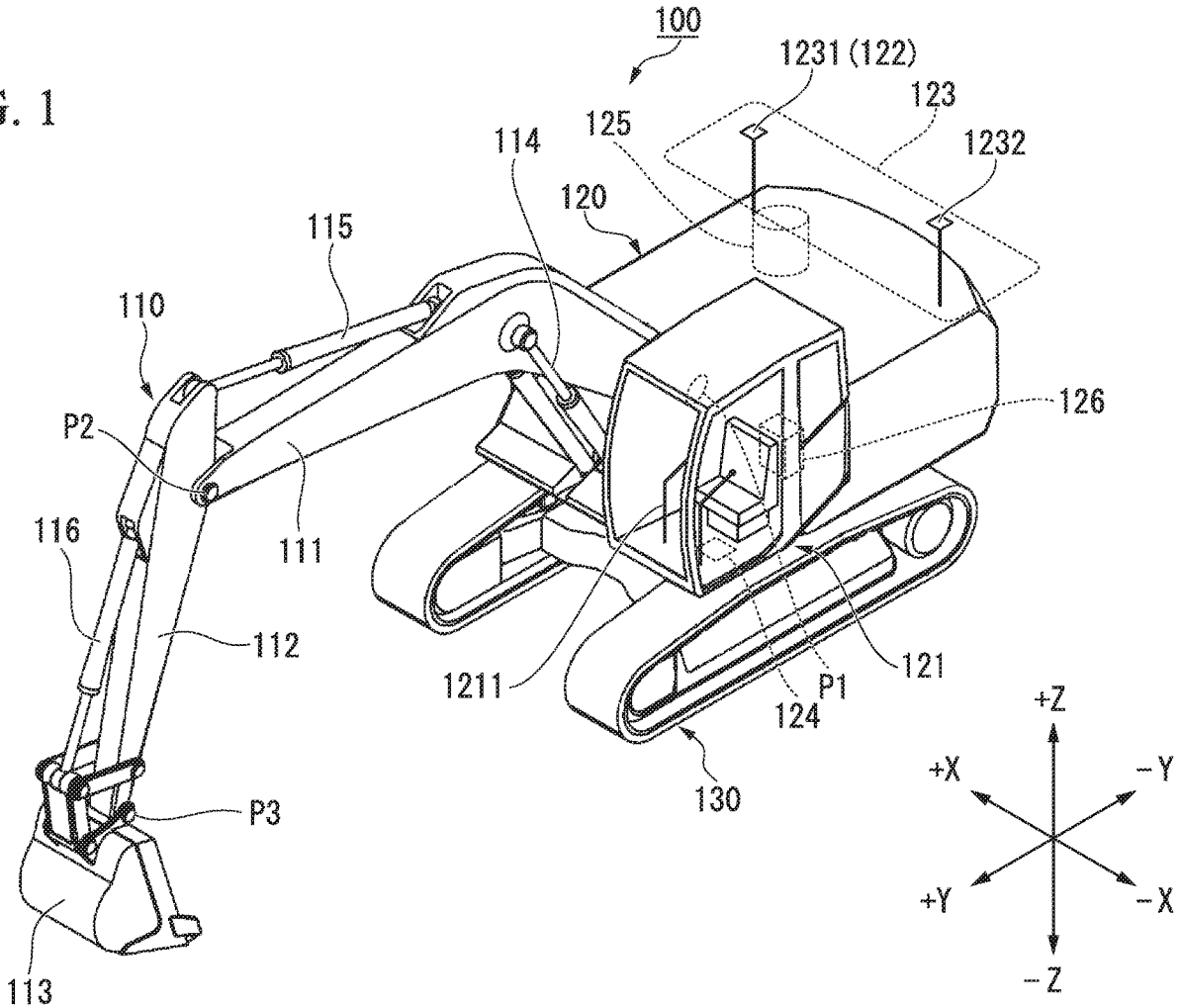
FIG. 1 is a perspective view showing a constitution of a hydraulic excavator according to a first embodiment.

FIG. 1 is a perspective view showing a constitution of a hydraulic excavator according to a first embodiment. In the first embodiment, a hydraulic excavator 100 is described as an example of a work machine. A work machine according to another embodiment may not necessarily be the hydraulic excavator 100.

The hydraulic excavator 100 is provided with work equipment 110 operated by hydraulic pressure, an excavator body 120 acting as an upper slewing body for supporting the work equipment 110, and an undercarriage 130 acting as a lower traveling body for supporting the excavator body 120.

The work equipment 110 is provided with a boom 111, an arm 112, a bucket 113, boom cylinders 114, an arm cylinder 115, and a bucket cylinder 116.

The boom 111 is a strut for supporting the arm 112 and the bucket 113. A proximal end of the boom 111 is mounted on a front part of the excavator body 120 via a pin P1.

The arm 112 connects the boom 111 and the bucket 113. A proximal end of the arm 112 is mounted on a distal end of the boom 111 via a pin P2.

The bucket 113 is a container having a blade for excavating earth, sand, or the like. A proximal end of the bucket 113 is mounted on a distal end of the arm 112 via a pin P3.

The boom cylinders 114 are hydraulic cylinders for operating the boom 111. Proximal ends of the boom cylinders 114 are mounted on the excavator body 120. Distal ends of the boom cylinders 114 are mounted on the boom 111.

The arm cylinder 115 is a hydraulic cylinder for driving the arm 112. A proximal end of the arm cylinder 115 is mounted on the boom 111. A distal end of the arm cylinder 115 is mounted on the arm 112.

The bucket cylinder 116 is a hydraulic cylinder for driving the bucket 113. A proximal end of the bucket cylinder 116 is mounted on the arm 112. A distal end of the bucket cylinder 116 is mounted on the bucket 113.

The excavator body 120 is provided with a cab 121 into which an operator boards. The cab 121 is provided in the front of the excavator body 120 and at a left side of the work equipment 110. In the first embodiment, on the basis of the cab 121, forward and backward directions are defined as +Y and −Y directions, leftward and rightward directions are defined as −X and +X directions, and upward and downward directions are defined as +Z and −Z directions.

A manipulator 1211 for operating the work equipment 110 is provided inside the cab 121. A working fluid is supplied to the boom cylinders 114, the arm cylinder 115, and the bucket cylinder 116 in response to an amount of manipulation of the manipulator 1211.

<<Control System of the Hydraulic Excavator>>

Figure 2:
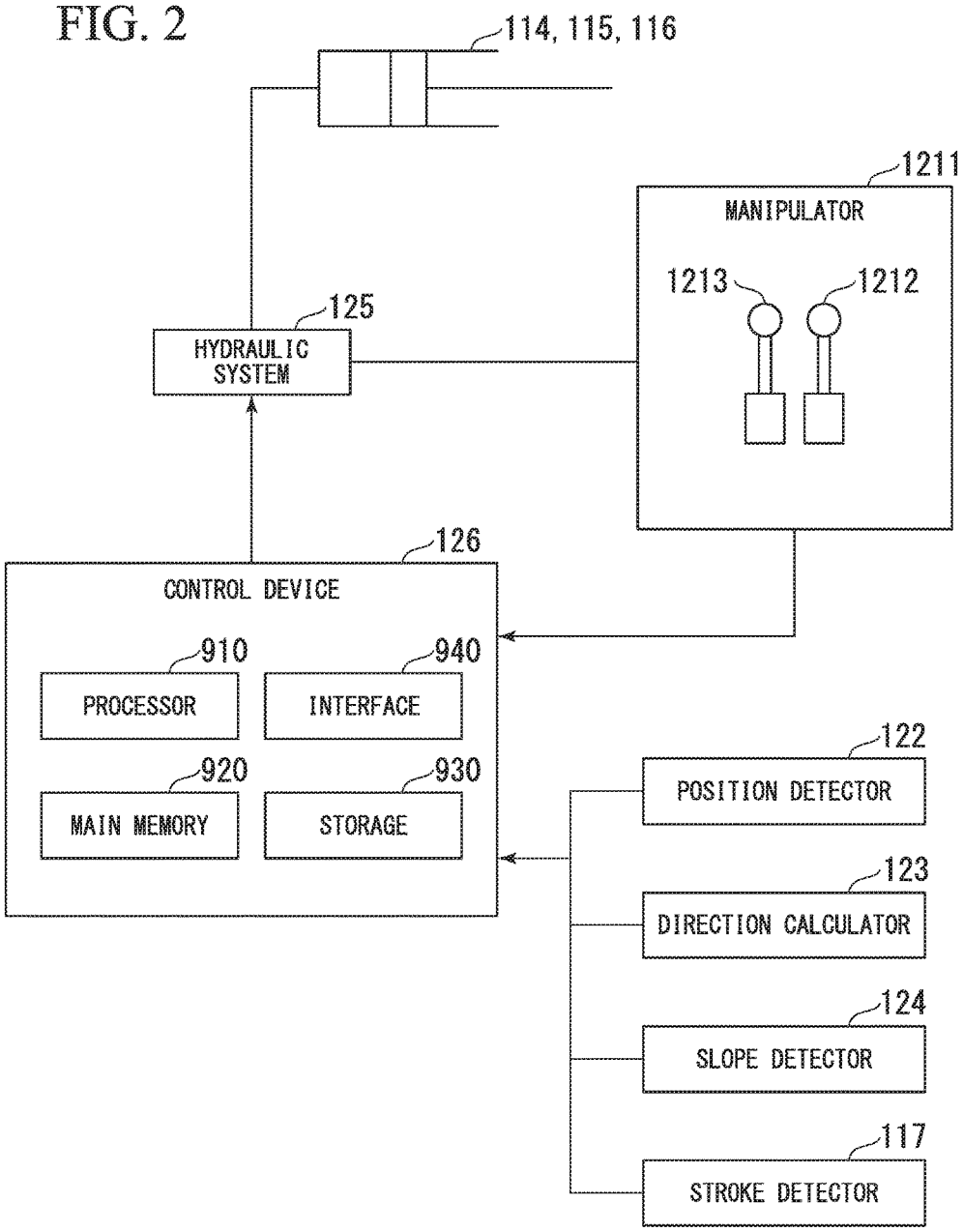
FIG. 2 is a schematic block diagram showing a constitution of a control system of the hydraulic excavator according to the first embodiment.

FIG. 2 is a schematic block diagram showing a constitution of a control system of the hydraulic excavator according to the first embodiment.

The hydraulic excavator 100 is provided with a stroke detector 117, the manipulator 1211, a position detector 122, a direction calculator 123, and a slope detector 124.

The stroke detector 117 detects a stroke length of each of the boom cylinders 114, the arm cylinder 115, and the bucket cylinder 116. Thereby, a control device 126 (to be described below) can detect a posture angle of the work equipment 110 on the basis of the stroke length of each of the boom cylinders 114, the arm cylinder 115, and the bucket cylinder 116. That is, in the first embodiment, the stroke detector 117 is an example of a means for detecting the posture angle of the work equipment 110. On the other hand, another embodiment is not limited thereto, and an angle detector such as a rotary encoder or a level gauge may be used as the means for detecting the posture angle of the work equipment 110 in place of the stroke detector 117 or in conjunction with the stroke detector 117.

The manipulator 1211 is provided with a right manipulation lever 1212 that is provided at a right side of the cab 121 and a left manipulation lever 1213 that is provided at a left side of the cab 121. The manipulator 1211 detects amounts of manipulation of the right manipulation lever 1212 in the forward/backward direction and the leftward/rightward direction and amounts of manipulation of the left manipulation lever 1213 in the forward/backward direction and the leftward/rightward direction, and outputs operation signals corresponding to the detected amounts of manipulation to the control device 126. A mode of generating operation signals from the manipulator 1211 according to the first embodiment is a PPC mode. The PPC mode is a mode in which pilot hydraulic pressures generated by manipulation of the right manipulation lever 1212 and manipulation of the left manipulation lever 1213 are detected by pressure sensors, and the operation signals are generated.

To be specific, a manipulation of the right manipulation lever 1212 in the forward direction corresponds to a command for a contracting motion of the boom cylinders 114 and a command for a lowering motion of the boom 111. A manipulation of the right manipulation lever 1212 in the backward direction corresponds to a command for an expanding motion of the boom cylinders 114 and a command for a raising motion of the boom 111. A manipulation of the right manipulation lever 1212 in the rightward direction corresponds to a command for a contracting motion of the bucket cylinder 116 and a command for a dumping motion of the bucket 113. A manipulation of the right manipulation lever 1212 in the leftward direction corresponds to a command for an expanding motion of the bucket cylinder 116 and a command for an excavating motion of the bucket 113. A manipulation of the left manipulation lever 1213 in the forward direction corresponds to a command for an expanding motion of the arm cylinder 115 and a command for an excavating motion of the arm 112. A manipulation of the left manipulation lever 1213 in the backward direction corresponds to a command for a contracting motion of the arm cylinder 115 and a command for a dumping motion of the arm 112. A manipulation of the left manipulation lever 1213 in the rightward direction corresponds to a command for a rightward slewing motion of the excavator body 120. A manipulation of the left manipulation lever 1213 in the leftward direction corresponds to a command for a leftward slewing motion of the excavator body 120.

The position detector 122 detects a position of the excavator body 120. The position detector 122 is provided with a first receiver 1231 that receives a positioning signal from an artificial satellite constituting a global navigation satellite system (GNSS). The position detector 122 detects a position of a representative point of the excavator body 120 in a global coordinate system on the basis of the positioning signal received by the first receiver 1231. The global coordinate system is a coordinate system in which a given point on the ground (for example, a position of a GNSS reference station installed at a construction site) is set as a reference point. An example of the GNSS may include a global positioning system (GPS).

The direction calculator 123 calculates a direction in which the excavator body 120 is directed. The direction calculator 123 is provided with the first receiver 1231 and a second receiver 1232 that receive the positioning signal from the artificial satellite constituting the GNSS. The first receiver 1231 and the second receiver 1232 are installed at different positions of the excavator body 120. The direction calculator 123 calculates the direction of the excavator body 120 as a relation of an installation position of the detected second receiver 1232 to an installation position of the detected first receiver 1231 using the positioning signal received by the first receiver 1231 and the positioning signal received by the second receiver 1232.

The slope detector 124 measures an acceleration and an angular velocity of the excavator body 120, and detects a slope (for example, a pitch indicating rotation about an X axis, a yaw indicating rotation about a Y axis, and a roll indicating rotation about a Z axis) of the excavator body 120 on the basis of the measured results. The slope detector 124 is installed on, for example, a lower surface of the cab 121. The slope detector 124 can use, for example, an inertial measurement unit (IMU) as an inertia measuring device.

A hydraulic system 125 is provided with a working fluid tank, a hydraulic pump, a flow control valve, and an electromagnetic proportional control valve. The hydraulic pump is driven by power of an engine (not shown) and supplies a working fluid to the boom cylinders 114, the arm cylinder 115, and the bucket cylinder 116 via the flow control valve. The electromagnetic proportional control valve restricts a pilot hydraulic pressure supplied from the manipulator 1211 on the basis of a control command received from the control device 126. The flow control valve has a rod-shaped spool and adjusts a flow rate of the working fluid supplied to the boom cylinders 114, the arm cylinder 115, and the bucket cylinder 116 according to a position of the spool. The spool is driven by the pilot hydraulic pressure adjusted by the electromagnetic proportional control valve. Another electromagnetic proportional control valve that restricts a source pressure supplied by the hydraulic pump is installed on a fluid path connected to the bucket cylinder 116 in parallel with the electromagnetic proportional control valve restricting the pilot hydraulic pressure. Thereby, the hydraulic excavator 100 can drive the bucket cylinder 116 according to a hydraulic pressure that is higher than the pilot hydraulic pressure generated by the manipulator 1211.

The control device 126 is provided with a processor 910, a main memory 920, a storage 930, and an interface 940.

A program for controlling the work equipment 110 is stored in the storage 930. An example of the storage 930 may include a hard disk drive (HDD), a non-volatile memory, and the like. The storage 930 may be an internal medium that is directly connected to a bus of the control device 126 or an external medium that is connected to the control device 126 via the interface 940 or a communication line.

The processor 910 retrieves the program from the storage 930, executes the retrieved program in the main memory 920, and performs a process according to the program. The processor 910 secures a storage area in the main memory 920 according to the program. The interface 940 is connected to the stroke detector 117, the manipulator 1211, the position detector 122, the direction calculator 123, the slope detector 124, the electromagnetic proportional control valve of the hydraulic system 125, and other peripherals, and communicates signals therewith.

The program may be a program for realizing a part of functions exhibited by the control device 126. For example, the program may be a program that exhibits a function by combining with another program previously stored in the storage 930 or combining with another program mounted on another device.

The control device 126 specifies a position of the bucket 113 by executing the program on the basis of the position detected by the position detector 122, the direction detected by the direction calculator 123, the slope angle of the excavator body 120 detected by the slope detector 124, and the stroke length detected by the stroke detector 117. The control device 126 outputs a control command for the boom cylinders 114 and a control command for the bucket cylinder 116 to the electromagnetic proportional control valve of the hydraulic system 125 on the basis of the specified position of the bucket 113 and the amount of manipulation of the manipulator 1211.

<<Posture of the Work Equipment>>

Figure 3:
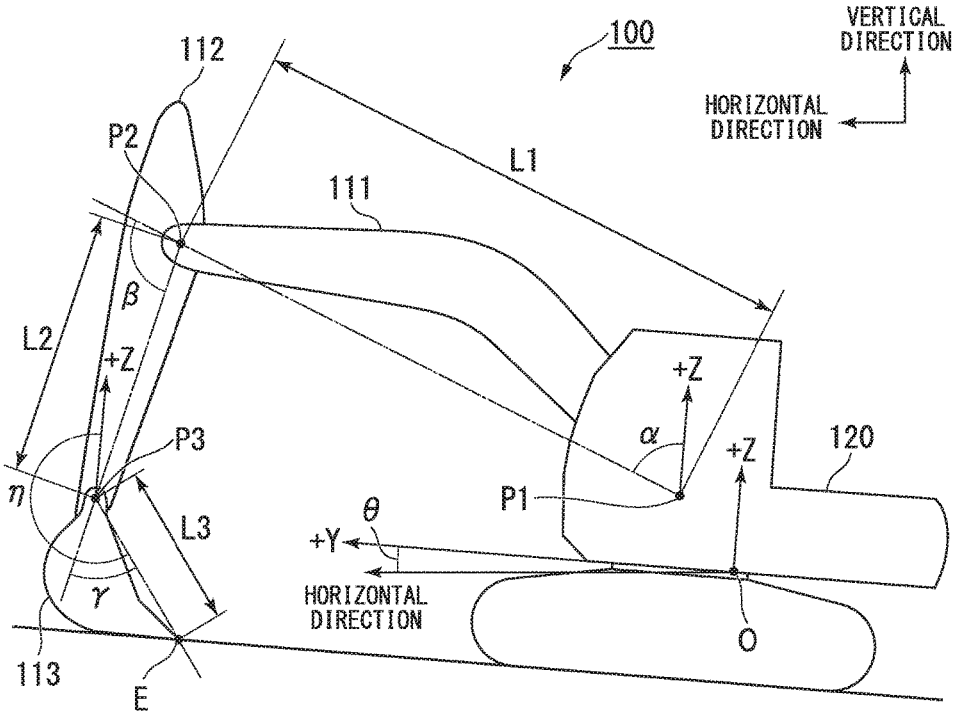
FIG. 3 is a view showing an example of a posture of work equipment.

FIG. 3 is a view showing an example of a posture of the work equipment 110.

The control device 126 calculates a posture of the work equipment 110 and generates a control command of the work equipment 110 on the basis of the posture. To be specific, the control device 126 calculates a posture angle $\alpha$ of the boom 111, a posture angle $\beta$ of the arm 112, a posture angle $\gamma$ of the bucket 113, and a position of each contour point of the bucket 113 as the posture of the work equipment 110.

The posture angle $\alpha$ of the boom 111 is represented by an angle formed by a half line extending from the pin P1 in the upward direction (in the +Z direction) of the excavator body 120 and a half line extending from the pin P1 to the pin P2. The upward direction of the excavator body 120 and a vertical upward direction do not necessarily coincide with each other by a slope (a pitch angle) $\theta$ of the excavator body 120.

The posture angle $\beta$ of the arm 112 is represented by an angle formed by the half line extending from the pin P1 to the pin P2 and a half line extending from the pin P2 to the pin P3.

The posture angle $\gamma$ of the bucket 113 is represented by an angle formed by the half line extending from the pin P2 to the pin P3 and a half line extending from the pin P3 to a blade edge E of the bucket 113.

Here, the sum of the posture angle $\alpha$ of the boom 111, the posture angle $\beta$ of the arm 112, and the posture angle $\gamma$ of the bucket 113 is referred to as a posture angle $\eta$ of the work equipment 110. The posture angle $\eta$ of the work equipment 110 is equal to an angle formed by a half line extending from the pin P3 in the upward direction (in the +Z direction) of the excavator body 120 and the half line extending from the pin P3 to the blade edge E of the bucket 113.

The position of each of the contour points of the bucket 113 is obtained from a dimension L1 of the boom 111, a dimension L2 of the arm 112, a dimension L3 of the bucket 113, the posture angle $\alpha$ of the boom 111, the posture angle $\beta$ of the arm 112, the posture angle $\gamma$ of the bucket 113, a contour shape of the bucket 113, the position of the representative point O of the excavator body 120, and a positional relation between the representative point O and the pin P1. The dimension L1 of the boom 111 is a distance from the pin P1 to the pin P2. The dimension L2 of the arm 112 is a distance from the pin P2 to the pin P3. The dimension L3 of the bucket 113 is a distance from the pin P3 to the blade edge E. The positional relation between the representative point O and the pin P1 is represented by, for example, X, Y and Z coordinate positions of the pin P1 on the basis of the representative point O. The positional relation between the representative point O and the pin P1 may be represented by, for example, a distance from the representative point O to the pin P1, a slope of a half line extending from the representative point O to the pin P1 in a direction of the X axis and a slope of the half line extending from the representative point O to the pin P1 in a direction of the Y axis.

<<Control Device of the Hydraulic Excavator>>

Figure 4:
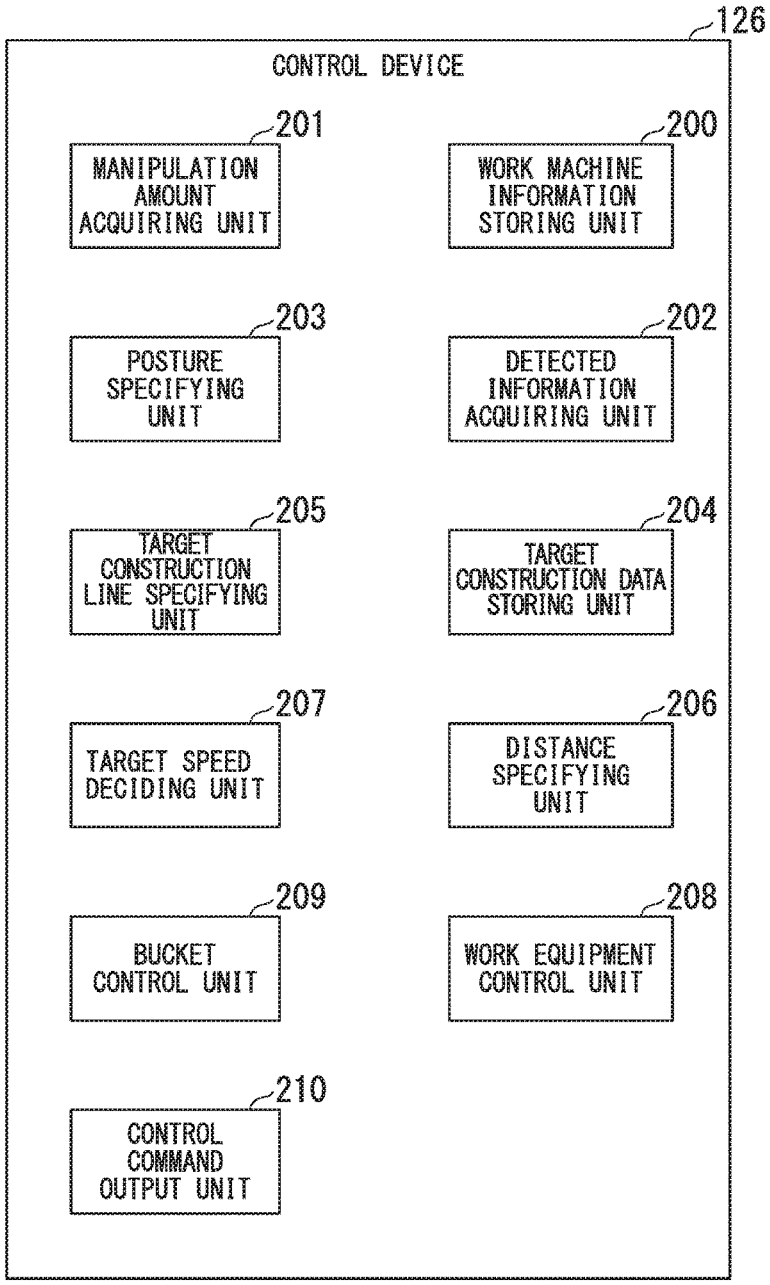
FIG. 4 is a block diagram showing a constitution of a control device of the hydraulic excavator according to the first embodiment.

FIG. 4 is a block diagram showing a constitution of the control device of the hydraulic excavator according to the first embodiment.

The control device 126 is provided with a work machine information storing unit 200, a manipulation amount acquiring unit 201, a detected information acquiring unit 202, a posture specifying unit 203, a target construction data storing unit 204, a target construction line specifying unit 205, a distance specifying unit 206, a target speed deciding unit 207, a work equipment control unit 208, a bucket control unit 209, and a control command output unit 210.

The work machine information storing unit 200 stores the dimension L1 of the boom 111, the dimension L2 of the arm 112, the dimension L3 of the bucket 113, the contour shape of the bucket 113, and the positional relation between the representative point O of the excavator body 120 and the pin P1.

The manipulation amount acquiring unit 201 acquires an operation signal indicating an amount of manipulation (the pilot hydraulic pressure or an angle of an electric lever) from the manipulator 1211. To be specific, the manipulation amount acquiring unit 201 acquires an amount of manipulation relating to the boom 111, an amount of manipulation relating to the arm 112, an amount of manipulation relating to the bucket 113, and an amount of manipulation relating to a slew.

The detected information acquiring unit 202 acquires information detected by each of the position detector 122, the direction calculator 123, the slope detector 124, and the stroke detector 117. To be specific, the detected information acquiring unit 202 acquires position information in the global coordinate system of the excavator body 120, the direction in which the excavator body 120 is directed, the slope of the excavator body 120, the stroke lengths of the boom cylinders 114, the stroke length of the arm cylinder 115, and the stroke length of the bucket cylinder 116.

The posture specifying unit 203 specifies the posture angle $\eta$ that is a state of the work equipment 110 on the basis of the information acquired by the detected information acquiring unit 202. To be specific, the posture specifying unit 203 specifies the posture angle $\eta$ of the work equipment 110 in the following order. The posture specifying unit 203 calculates the posture angle $\alpha$ of the boom 111 from the stroke lengths of the boom cylinders 114. The posture specifying unit 203 calculates the posture angle $\beta$ of the arm 112 from the stroke length of the arm cylinder 115. The posture specifying unit 203 calculates the posture angle $\gamma$ of the bucket 113 from the stroke length of the bucket cylinder 116.

The posture specifying unit 203 specifies the position in the global coordinate system with respect to a plurality of contour points of the bucket 113 on the basis of the calculated posture angle, the information acquired by the detected information acquiring unit 202, and the information stored in the work machine information storing unit 200. The contour points of the bucket 113 include a plurality of points of the blade edge E of the bucket 113 in a width direction (the X direction) and a plurality of points of a bottom plate thereof in the width direction. To be specific, the posture specifying unit 203 specifies the posture angle $\alpha$ of the boom 111, the posture angle $\beta$ of the arm 112, the posture angle $\gamma$ of the bucket 113, the dimension L1 of the boom 111, the dimension L2 of the arm 112, the dimension L3 of the bucket 113, the contour shape of the bucket 113, the positional relation between the representative point O and the pin P1, the position of the representative point O of the excavator body 120, the direction in which the excavator body 120 is directed, and the positions of the contour points of the bucket 113 in the global coordinate system from the slope $\theta$ of the excavator body 120.

The posture specifying unit 203 is an example of a work equipment state specifying unit that specifies the state of the work equipment 110.

The target construction data storing unit 204 stores target construction data that indicates a target shape of an excavation object at a construction site. The target construction data is three-dimensional data represented by the global coordinate system, stereographic topographical data made up of a plurality of triangular polygons indicating a target construction surface, or the like. The target construction data is read from an external storage medium or is received from an external sever via a network, and is thereby stored in the target construction data storing unit 204.

The target construction line specifying unit 205 specifies a target construction line on the basis of the target construction data stored in the target construction data storing unit 204 and the positions of the contour points of the bucket 113 specified by the posture specifying unit 203. The target construction line is represented by an intersecting line between a driving surface of the bucket 113 (a surface orthogonal to the X axis passing through the bucket 113) and the target construction data. To be specific, the target construction line specifying unit 205 specifies the target construction line in the following order.

The target construction line specifying unit 205 specifies a position that is located at the lowest side (a position whose height is lowest) among the contour points of the bucket 113 and corresponds to a reference position of the work equipment 110. The target construction line specifying unit 205 specifies a target construction surface that is located vertically below the specified contour point. The target construction surface regulated by the target construction line specifying unit 205 may be a technique for specifying a target construction surface located the shortest distance from the bucket 113. A reference of the work equipment 110 used herein is not limited to a contour of the bucket 113, and may be arbitrarily specified on the work equipment 110.

Next, the target construction line specifying unit 205 calculates an intersecting line between the driving surface of the bucket 113, which passes through the specified contour point and the target construction surface, and the target construction data as the target construction line. The target construction line calculated by the target construction line specifying unit 205 may be regulated to be a segment line as well as a topographical shape having a width.

The target construction line specifying unit 205 is an example of a control reference specifying unit that specifies a control reference of the work equipment 110.

The distance specifying unit 206 specifies a distance between the bucket 113 and the target construction line (an excavation object position).

The target speed deciding unit 207 decides a target speed of the boom 111 on the basis of the amount of manipulation of the right manipulation lever 1212 in the forward/backward direction, which is acquired by the manipulation amount acquiring unit 201. The target speed deciding unit 207 decides a target speed of the arm 112 on the basis of the amount of manipulation of the left manipulation lever 1213 in the forward/backward direction, which is acquired by the manipulation amount acquiring unit 201. The target speed deciding unit 207 decides a target speed of the bucket 113 on the basis of the amount of manipulation of the right manipulation lever 1212 in the leftward/rightward direction, which is acquired by the manipulation amount acquiring unit 201.

The work equipment control unit 208 performs work equipment control of controlling the work equipment 110 such that the bucket 113 is not intruded below the target construction line on the basis of the distance specified by the distance specifying unit 206. The work equipment control according to the first embodiment is control of deciding a speed limit of the boom 111 such that the bucket 113 is not intruded below the target construction line and generating a control command of the boom 111. To be specific, the work equipment control unit 208 decides the speed limit of the boom 111 in a vertical direction from a speed limit table indicating a relation between a distance between the bucket 113 and the excavation object position and a speed limit of the work equipment 110.

Figure 5:
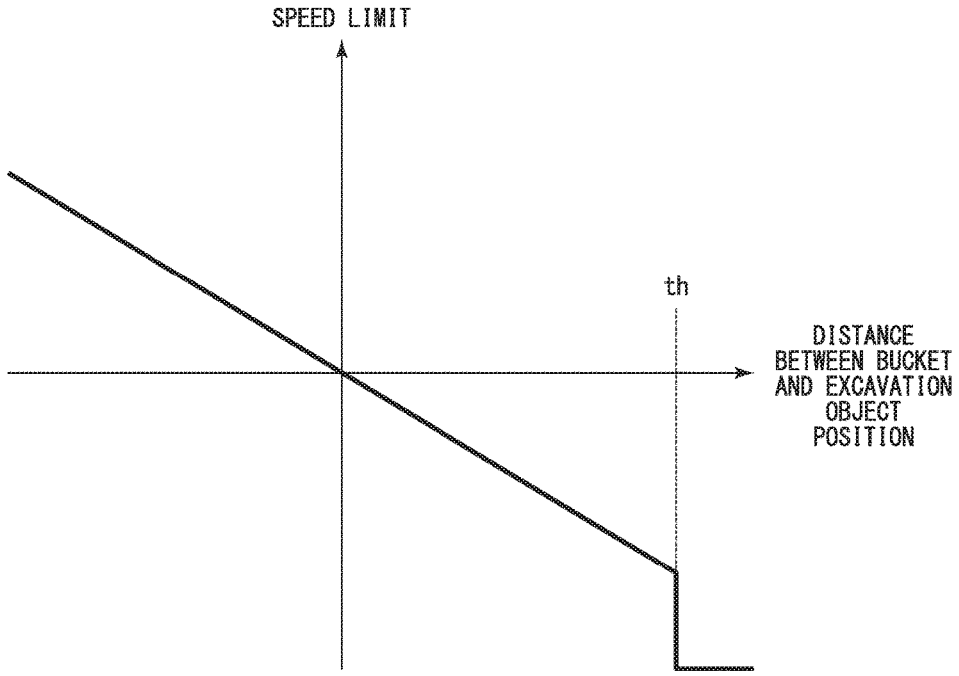
FIG. 5 is a view showing an example of a speed limit table.

FIG. 5 is a view showing an example of a speed limit table. As shown in FIG. 5, according to the speed limit table, when the distance between the bucket 113 and the excavation object position is zero, a vertical component of a speed of the work equipment 110 becomes zero. In the speed limit table, when a lowest point of the bucket 113 is located above the target construction line, the distance between the bucket 113 and the excavation object position is expressed as a positive value. On the other hand, when the lowest point of the bucket 113 is located below the target construction line, the distance between the bucket 113 and the excavation object position is expressed as a negative value. In the speed limit table, a speed when the bucket 113 is moved upward is expressed as a positive value. When the distance between the bucket 113 and the excavation object position is less than or equal to a work equipment control threshold th, which is a positive value, the speed limit of the work equipment 110 is regulated based on the distance between the bucket 113 and the excavation object position. When the distance between the bucket 113 and the excavation object position is more than or equal to the work equipment control threshold th, an absolute value of the speed limit of the work equipment 110 has a greater value than the maximum value of a target speed of the work equipment 110. That is, since the absolute value of the target speed of the work equipment 110 is always smaller than the absolute value of the speed limit when the distance between the bucket 113 and the excavation object position is more than or equal to the work equipment control threshold th, the boom 111 is always driven at the target speed.

When the absolute value of the speed limit is smaller than an absolute value of the sum of vertical components of target speeds of the boom 111, the arm 112, and the bucket 113, the work equipment control unit 208 subtracts the vertical component of the target speed of the arm 112 and the vertical component of the target speed of the bucket 113 from the speed limit, thereby calculating the speed limit of the boom 111 in the vertical direction. The work equipment control unit 208 calculates the speed limit of the boom 111 from the speed limit of the boom 111 in the vertical direction.

When bucket control start conditions are met, the bucket control unit 209 starts bucket control of controlling the bucket 113 such that the posture angle η of the work equipment 110 becomes a constant angle. The bucket control unit 209 decides a control speed of the bucket 113 on the basis of speeds of the boom 111 and the arm 112. The speeds of the boom 111 and the arm 112 are obtained by a stroke length per unit time detected by the stroke detector 117. The bucket control start conditions according to the first embodiment are conditions that the distance between the bucket 113 and the excavation object position is less than a bucket control start threshold, that the amount of manipulation relating to the bucket is less than a given threshold (an angle corresponding to an allowance of the manipulator 1211), and that the work equipment control is being performed.

When a bucket control complete condition is met, the bucket control unit 209 completes the bucket control. The bucket control complete condition according to the first embodiment is a condition that the distance between the bucket 113 and the excavation object position is more than or equal to a bucket control complete threshold, that the amount of manipulation relating to the bucket is more than or equal to the given threshold, or that the work equipment control is not being performed. The bucket control start threshold is a smaller value than the bucket control complete threshold. The bucket control start threshold is a value that is less than or equal to the work equipment control threshold th. When the work equipment control is not performed by the manipulation or the like of the operator, the bucket control unit 209 does not perform the bucket control.

The control command output unit 210 outputs the control command of the boom 111 generated by the work equipment control unit 208 to the electromagnetic proportional control valve of the hydraulic system 125. The control command output unit 210 outputs the control command of the bucket 113 generated by the bucket control unit 209 to the electromagnetic proportional control valve of the hydraulic system 125.

<<Operation>>

Here, a method of controlling the hydraulic excavator 100 by the control device 126 according to the first embodiment will be described.

Figure 6:
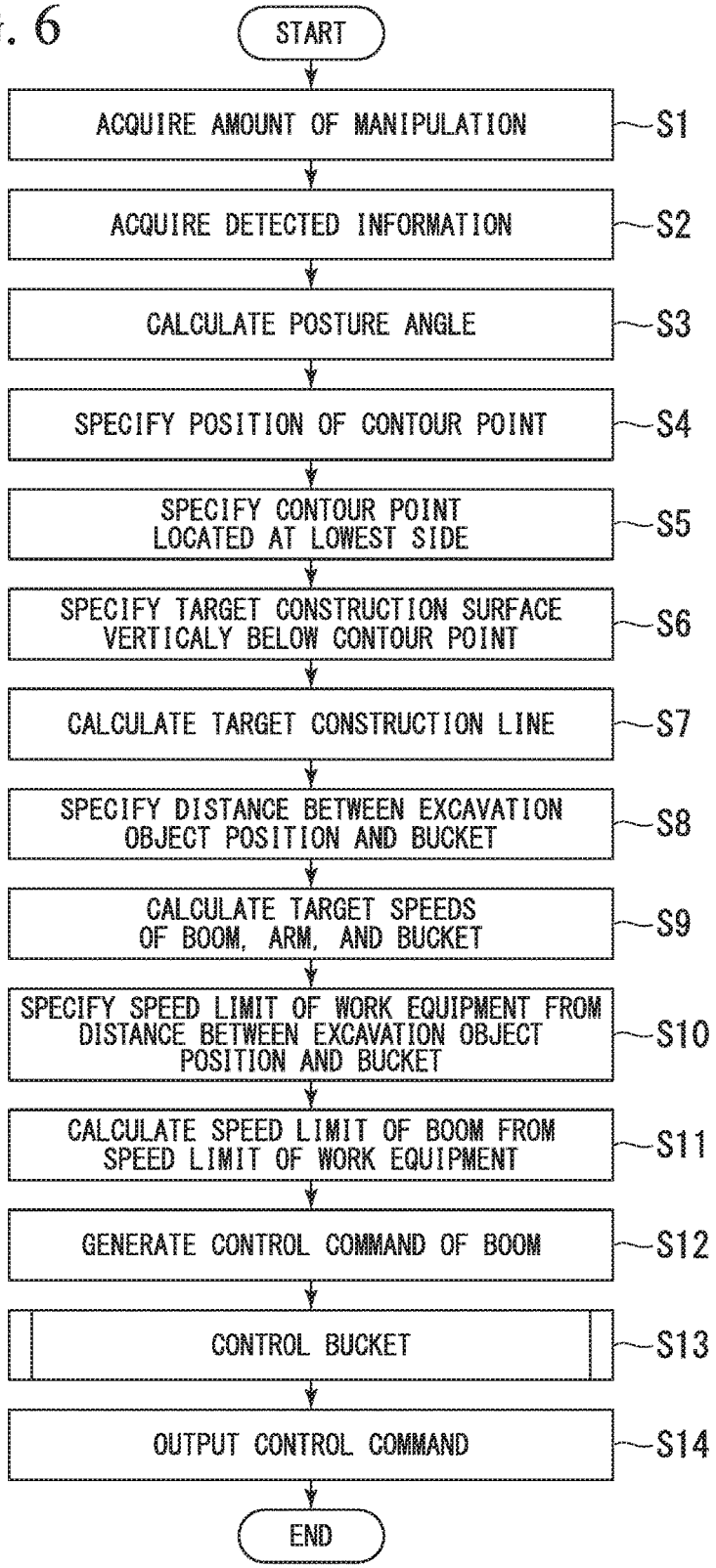
FIG. 6 is a flow chart showing an operation of the control device according to the first embodiment.

FIG. 6 is a flow chart showing an operation of the control device according to the first embodiment. The control device 126 performs control shown below at given control periods.

The manipulation amount acquiring unit 201 acquires an amount of manipulation relating to the boom 111, an amount of manipulation relating to the arm 112, an amount of manipulation relating to the bucket 113, and an amount of manipulation relating to a slew from the manipulator 1211 (step S1). The detected information acquiring unit 202 acquires information detected by each of the position detector 122, the direction calculator 123, the slope detector 124, and the stroke detector 117 (step S2).

The posture specifying unit 203 calculates the posture angle α of the boom 111, the posture angle β of the arm 112, and the posture angle γ of the bucket 113 from a stroke length of each of the hydraulic cylinders (step S3). The posture specifying unit 203 calculates positions of contour points of the bucket 113 in the global coordinate system on the basis of the calculated posture angles α, β and γ, the dimension L1 of the arm 112, the dimension L2 of the bucket 113, the dimension L3 of the boom 111, and a shape of the boom 111 which are stored in the work machine information storing unit 200, and a position, a direction, and a slope of the excavator body 120 which is acquired by the detected information acquiring unit 202 (step S4).

The target construction line specifying unit 205 specifies a contour point located at the lowest position in the global coordinate system among the contour points of the bucket 113 (step S5). The target construction line specifying unit 205 specifies a target construction surface that is located vertically below the specified contour point (step S6). Next, the target construction line specifying unit 205 calculates an intersecting line between a driving surface of the bucket 113, which passes through the specified contour point and the target construction surface, and target construction data as a target construction line (step S7). The distance specifying unit 206 specifies a distance between the bucket 113 and an excavation object position (step S8). The target speed deciding unit 207 calculates target speeds of the boom 111, the arm 112, and the bucket 113 on the basis of the amounts of manipulation acquired by the manipulation amount acquiring unit 201 in step S1 (step S9).

Next, the work equipment control unit 208 specifies a speed limit of the work equipment 110 associated with the distance between the bucket 113 and the excavation object position, which is specified by the distance specifying unit 206 according to the table shown in FIG. 5 (step S10). Next, the work equipment control unit 208 calculates a speed limit of the boom 111 on the basis of the target speeds of the arm 112 and the bucket 113 and the speed limit of the work equipment 110 (step S11). The work equipment control unit 208 generates a control command of the boom 111 and a control command of the bucket 113 on the basis of the speed limit of the boom 111 which is generated by the work equipment control unit 208 (step S12).

Figure 7:
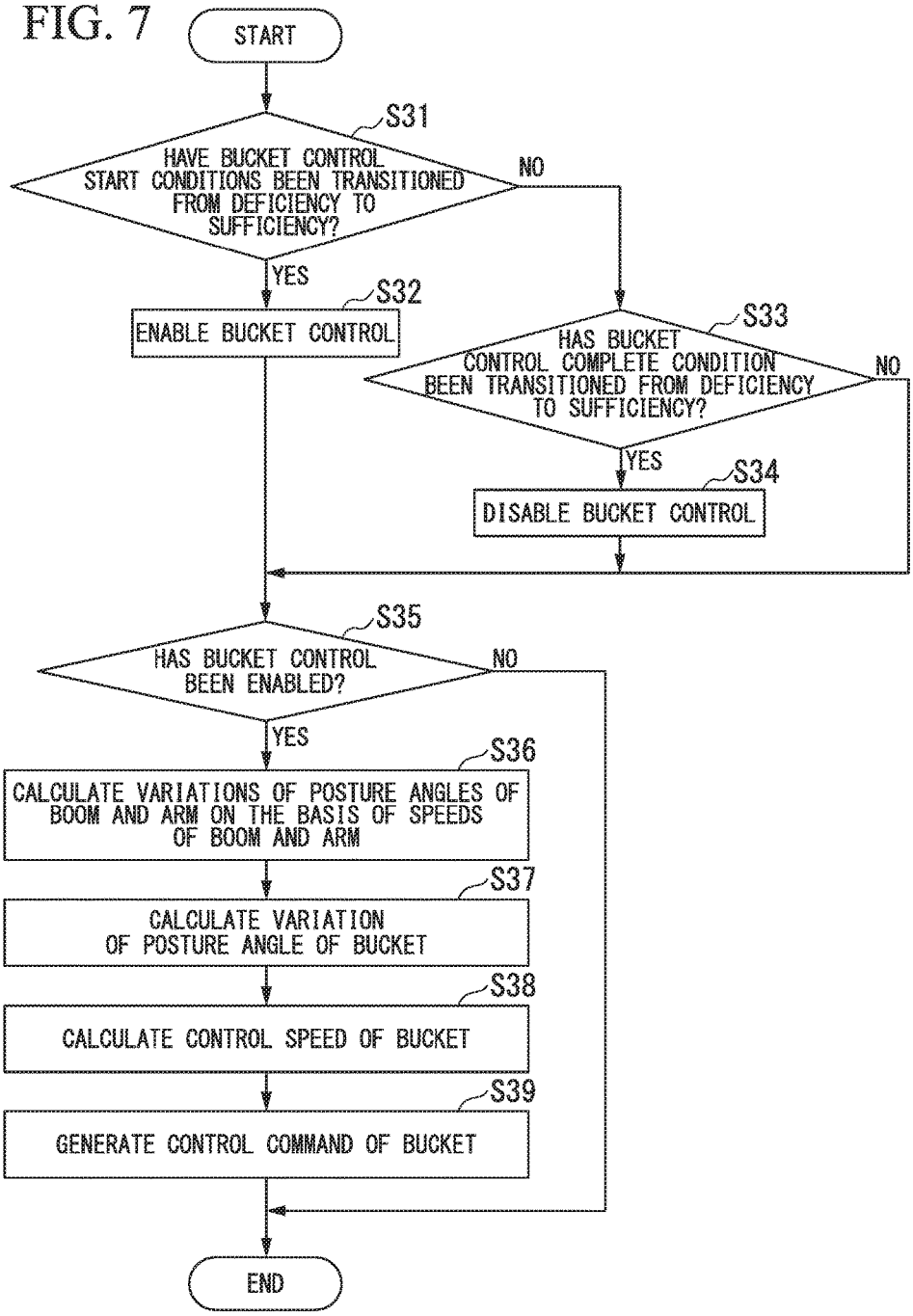
FIG. 7 is a flow chart showing a bucket control determining process according to the first embodiment.

When the work equipment control unit 208 generates the control command of the boom 111, the bucket control unit 209 performs a bucket controlling process shown below (step S12). FIG. 7 is a flow chart showing a bucket controlling process according to the first embodiment.

The bucket control unit 209 determines whether a state of the hydraulic excavator 100 has been transitioned from a state in which bucket control start conditions are not met to a state in which the bucket control start conditions are met on the basis of the distance specified by the distance specifying unit 206 in step S8 and the amounts of manipulation acquired by the manipulation amount acquiring unit 201 in step S1 (step S31). When the state of the hydraulic excavator 100 has been transitioned from the state in which the bucket control start conditions are not met to the state in which the bucket control start conditions are met (YES in step S31), the bucket control unit 209 enables bucket control (step S32). That is, the bucket control unit 209 decides a control speed of the bucket 113 to hold the posture angle $\eta$ of the work equipment 110 after the bucket control start conditions are met.

On the other hand, when the state of the hydraulic excavator 100 is the state in which the bucket control start conditions are not met or when the bucket control start conditions have already been met (NO in step S31), the bucket control unit 209 determines whether the state of the hydraulic excavator 100 transitions from the state in which a bucket control complete condition is not met to the state in which the bucket control complete condition is met (step S33). When the state of the hydraulic excavator 100 transitions from the state in which the bucket control complete condition is not met to the state in which the bucket control complete condition is met (YES in step S33), the bucket control unit 209 disables the bucket control (step S34). That is, the bucket control unit 209 does not decide a control speed of the bucket 113 after the bucket control complete condition is met.

When the bucket control is enabled, when the bucket control is disabled, or when a transition from deficiency to sufficiency of the bucket control start conditions and a transition from deficiency to sufficiency of the bucket control complete condition do not occur (NO in step S33), the bucket control unit 209 determines whether the bucket control is enabled (step S35). When the bucket control is disabled (NO in step S35), the bucket control unit 209 completes the bucket controlling process without calculating the control speed of the bucket 113. In contrast, when the bucket control is enabled (YES in step S35), the bucket control unit 209 calculates a variation $\Delta\alpha$ of the posture angle of the boom 111 and a variation $\Delta\beta$ of the posture angle of the arm 112 on the basis of the speeds of the boom 111 and the arm 112 (step S36). Next, the bucket control unit 209 obtains a reciprocal of the sum of the variation $\Delta\alpha$ and the variation $\Delta\beta$, thereby calculating a variation $\Delta\gamma$ of the posture angle of the bucket 113 (step S37). The bucket control unit 209 converts the variation $\Delta\gamma$ into speed, thereby calculating the control speed of the bucket 113 (step S38). The bucket control unit 209 generates a control command of the bucket 113 on the basis of the control speed of the bucket 113 (step S39), and completes the bucket controlling process.

When the control device 126 completes the bucket controlling process, the control command output unit 210 outputs the control command of the boom 111 generated by the work equipment control unit 208 and the control command of the bucket 113 generated by the bucket control unit 209 to the electromagnetic proportional control valve of the hydraulic system 125 (step S14).

Thereby, the hydraulic system 125 drives the boom cylinders 114, the arm cylinder 115, and the bucket cylinder 116. When the bucket control unit 209 does not calculate the control speed of the bucket 113 because the bucket control is disabled, the control command of the bucket 113 is not output to the electromagnetic proportional control valve. In this case, the hydraulic system 125 drives the bucket cylinder 116 on the basis of a pilot hydraulic pressure generated by the manipulator 1211.

<<Operation and Effects>>

Figure 8:
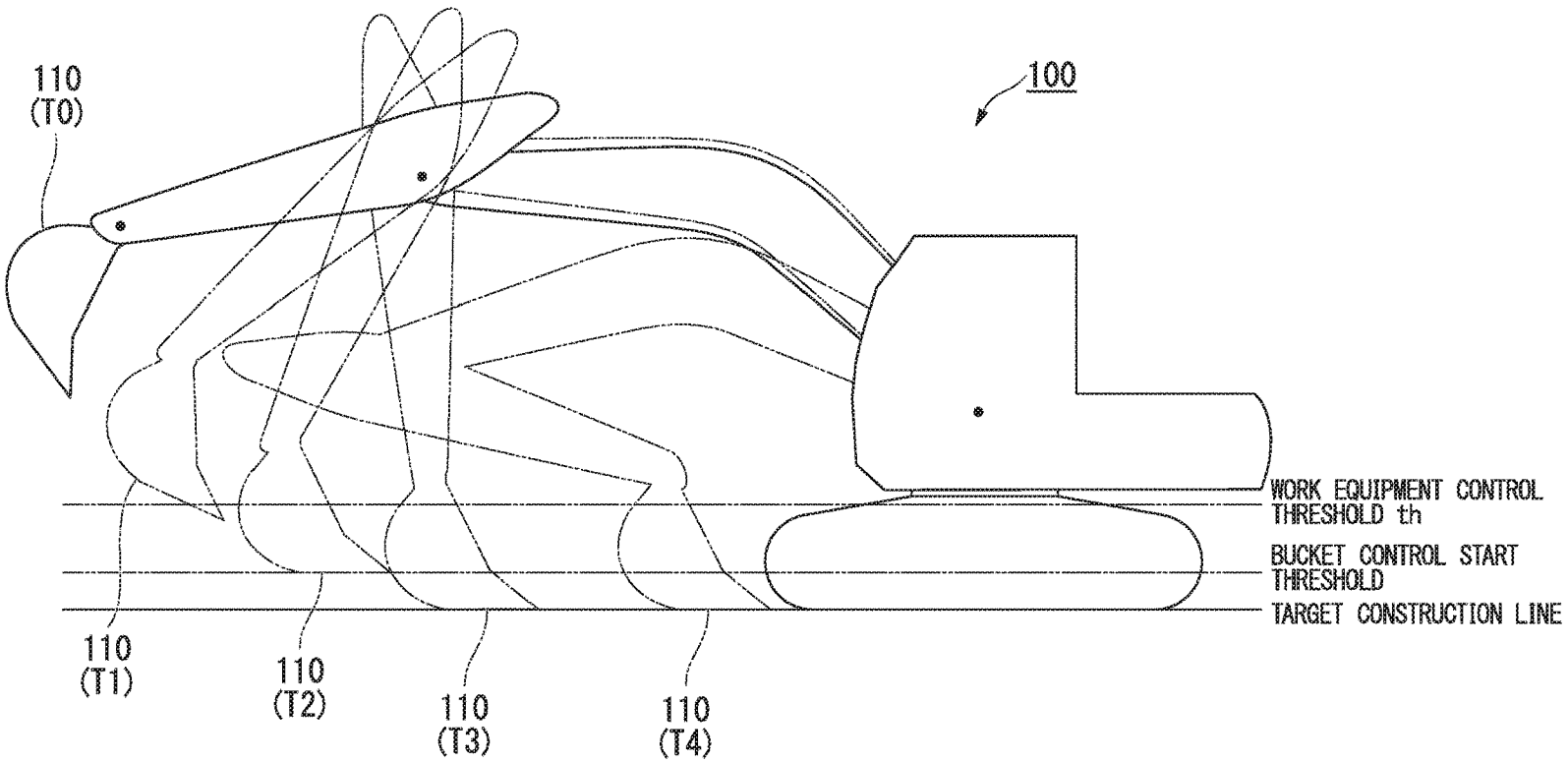
FIG. 8 is a view showing an example of a behavior of the hydraulic excavator according to the first embodiment.

FIG. 8 is a view showing an example of a behavior of the hydraulic excavator 100 according to the first embodiment.

In this way, according to the first embodiment, when a distance between the bucket 113 and a target construction line (an excavation object position) is less than the bucket control start threshold, the control device 126 controls the bucket 113 (performs the bucket control) so as to adjust an angle of the bucket 113 to a constant angle. For example, as shown in FIG. 8, when an operator performs a manipulation of driving the arm 112 in an excavating direction from a time T0 to a time T4, a posture angle of the work equipment 110 is not controlled between the time T0 to a time T1 between which a distance between a lowest position of the bucket 113 and the target construction line is more than or equal to the bucket control start threshold. That is, control over the boom 111 is performed between the time T1 to a time T2. Meanwhile, the control over the boom 111 and control over the bucket 113 are performed between the time T2 and the time T4 between which the distance between the lowest position of the bucket 113 and the target construction line is less than the bucket control start threshold. When the bucket 113 is sufficiently near the target construction line, there is a high probability in that the operator plans to perform finishing excavation of the excavation object. Therefore, when the bucket 113 is sufficiently near the target construction line, the control device 126 performs the bucket control. Thereby, without explicit manipulation from the operator, the angle of the bucket can be kept constant during excavating work.

According to the first embodiment, the control device 126 performs the work equipment control of controlling the boom 111 such that the bucket 113 is not intruded below the target construction line and the bucket control of controlling the bucket 113 such that the angle of the bucket 113 becomes a constant angle. That is, the control device 126 controls a height of the work equipment 110 using the boom 111 without intervening in the operation of the arm 112 by which an excavation intention of the operator is strongly expressed, and the posture of the work equipment 110 is controlled by the bucket 113. Thereby, the control device 126 can make height control and angle control of excavation compatible with each other without damaging an operational feeling of the operator.

Here, in the posture control of the work equipment disclosed in Patent Document 2, control commands are output for a manipulation of a lever and for each of a boom, an arm, and a bucket. In this case, the lever manipulation reflecting the excavation desire of the operator and a behavior of the arm may not coincide with each other. For example, in a typical hydraulic excavator without a function of work equipment control, when a posture angle of the arm is vertical, a horizontal component of a speed of the bucket is accelerated in comparison with a case in which the posture angle of the arm is not vertical. However, in the posture control disclosed in Patent Document 2, since the work equipment does not necessarily assume the above-described behavior, there is a possibility in that the operator feels a sense of incompatibility about a difference between the manipulation of the lever and an actual behavior of the work equipment. In contrast, according to the first embodiment, since the control device 126 does not intervene in the behavior of the arm 112, it can reduce a possibility in that the operator feels a sense of incompatibility.

In the posture control of the work equipment disclosed in Patent Document 2, the posture control may not sufficiently cope with a case where control commands are unexpected when disturbance occurs, such as, for example, contact with rocks, during excavation work. In contrast, according to the first embodiment, even when a disturbance occurs, the posture control can cope with the disturbance by only changing a control over the bucket control. For this reason, countermeasures against a disturbance are frequently facilitated. In this way, the posture control of the work equipment according to the first embodiment is used in the overall excavation work, and thereby workability for the operator is improved.

On the other hand, a hydraulic excavator 100 according to another embodiment may not have a working function of work equipment. The hydraulic excavator 100 according to another embodiment may intervene in a behavior of an arm 112 in work equipment control.

According to the first embodiment, the bucket control start threshold is set to a value that is less than or equal to the work equipment control threshold th at which intervention in the behavior of the boom 111 occurs by the work equipment control. That is, no bucket control is performed as long as the intervention in the operation of the boom 111 does not occur. In a range in which the work equipment control is not performed, there is a high possibility in that the operator plans to perform coarse excavation, and there is a low possibility in that the operator plans to perform finishing excavation. Therefore, the control device 126 can prevent the angle of the bucket 113 from being unnecessarily controlled by the bucket control start threshold being less than or equal to the work equipment control threshold th. On the other hand, in the hydraulic excavator 100 according to the other embodiment, the bucket control threshold may be greater than the work equipment control threshold th.

According to the first embodiment, when an amount of manipulation relating to the operation of the bucket 113 is less than a given threshold and when a distance between the bucket 113 and the excavation object position is less than the bucket control threshold, the control device 126 may be adopted to perform the bucket control. When the bucket 113 is operated by the manipulator 1211, there is a high probability in that the operator himself plans to control the bucket. Therefore, the control device 126 performs the bucket control when the amount of manipulation relating to the operation of the bucket 113 is small. Thereby, it is possible to prevent the angle of the bucket 113 from being unnecessarily controlled.

<Other Embodiment>

While the embodiment has been described in detail with reference to the drawings, the specific constitution is not limited to the above constitution, and various changes in design can be made.

The mode of generating an operation signal from the manipulator 1211 according to the first embodiment is the PPC mode, but it may be, for example, an electric lever mode without being limited thereto. The electric lever mode is a mode in which operation angles of the right manipulation lever 1212 and the left manipulation lever 1213 are detected by potentiometers, and the operation signals are generated. In this case, the control device 126 generates the control commands of the boom 111, the arm 112, and the bucket 113 on the basis of target speeds of the boom 111, the arm 112, and the bucket 113, a speed limit of the boom 111, and a control speed of the bucket 113, thereby controlling the electromagnetic proportional control valve.

The control device 126 according to the first embodiment controls the excavator body 120 and the work equipment 110 on the basis of the position information of the global coordinate system, but it is not limited thereto. For example, a control device 126 according to another embodiment may convert the position information of the global coordinate system into a local coordinate system based on the position of the excavator body 120, and may control the excavator body 120 and the work equipment 110 on the basis of position information of the local coordinate system.

The control device 126 according to the first embodiment is adopted to maintain the state of the work equipment 110 in the bucket control and controls the bucket 113 to make the posture angle $\eta$ of the work equipment 110 constant, but it is not limited thereto. For example, the control device 126 according to another embodiment may control the bucket 113 to make the angle of the bucket 113 constant in relation to the target construction line in the global coordinate system of the work equipment 110. A method of obtaining the posture angle in the global coordinate system of the work equipment 110 may include a method of adding the pitch angle $\theta$ to the posture angle $\eta$ or a method of installing a slope sensor on the bucket 113.

The bucket control start conditions according to the first embodiment includes the condition that the distance between the bucket 113 and the excavation object position is less than the bucket control start threshold, but it is not limited thereto. The bucket control start conditions may include a condition that a relation between the state of the work equipment 110 and the control reference of the work equipment meets a given relation. For example, the bucket control start conditions according to another embodiment may include a condition that a distance between the bucket 113 and a surface of the ground is less than the bucket control start threshold. In this case, the surface of the ground is an example of the control reference.

The control device 126 according to the first embodiment calculates the control speed of the bucket 113 on the basis of the speeds of the boom 111 and the arm 112, but it is not limited thereto. For example, the control device 126 according to another embodiment may calculate the control speed of the bucket 113 on the basis of the target speeds of the boom 111 and the arm 112 and the speed limit of the boom 111. The control device 126 according to the other embodiment may store the posture angle $\eta$ of the work equipment 110 when the bucket control start conditions are met, calculate the posture angle $\eta$ after a lapse of unit time, and calculate the control speed of the bucket 113 such that the posture angle $\eta$ after the lapse of unit time coincides with the stored posture angle $\eta$.

The control device 126 according to the first embodiment can be applied a work machine provided with the work equipment without being limited to a hydraulic excavator.

INDUSTRIAL APPLICABILITY

According to the embodiments, the control device can maintain a constant angle of a bucket during excavation work without explicit manipulation from an operator.

REFERENCE SIGNS LIST

100 Work machine
111 Boom
112 Arm
113 Bucket
114 Boom cylinder
115 Arm cylinder
116 Bucket cylinder
126 Control device
200 Work machine information storing unit
201 Manipulation amount acquiring unit
202 Detected information acquiring unit
203 Posture specifying unit
204 Target construction data storing unit
205 Target construction line specifying unit
206 Distance specifying unit
207 Target speed deciding unit
208 Work equipment control unit
209 Bucket control unit
211 Control command output unit

What is claimed is:

1. A work equipment control device for controlling a work machine provided with work equipment including a bucket, the work equipment control device comprising:

a work equipment state specifying unit configured to specify a state of the work equipment;

a control reference specifying unit configured to specify a control reference of the work equipment;

a distance specifying unit configured to specify a distance between the work equipment and the control reference; and a bucket control unit configured to output a control command to drive the bucket such that a posture of the bucket is kept constant when the distance between the work equipment and the control reference is less than a bucket control start threshold and stop outputting the control command when the distance between the work equipment and the control reference is more than or equal to a bucket control complete threshold which is greater than the bucket control start threshold.

2. The work equipment control device according to claim 1, further comprising:

a work equipment control unit configured to output a control command restricting a speed of the work equipment such that the bucket is not intruded below the control reference when the distance between the work equipment and the control reference is less than a work equipment control threshold, wherein the bucket control start threshold is less than or equal to the work equipment control threshold.

3. The work equipment control device according to claim 1, further comprising:

a manipulation amount acquiring unit configured to acquire an amount of manipulation of a manipulator for operating the work equipment, wherein the bucket control unit outputs the control command driving the bucket such that the posture of the bucket is kept constant when an amount of manipulation relating to an operation of the bucket is less than a predetermined threshold and when the distance between the work equipment and the control reference is less than a bucket control threshold.

4. The work equipment control device according to claim 1, further comprising:

a target construction information storing unit configured to store target construction data that indicates a target shape of an excavation object at a construction site, wherein the work equipment control reference specifying unit specifies a target construction line, which is represented by a relation between the work equipment and the target construction data, as the control reference on the basis of the target construction data stored by the target construction information storing unit, and the distance specifying unit specifies a distance between the work equipment and an excavation object position that is a point on the target construction line directly below the work equipment.

5. The work equipment control device according to claim 1, wherein the distance specifying unit specifies a distance between the control reference and a position that is closest to the control reference on a contour of the bucket and becomes a reference position of the work equipment.

6. The work equipment control device according to claim 5, wherein the bucket control unit outputs the control command such that a sum of a posture angle of a boom of the work equipment, a posture angle of an arm of the work equipment, and a posture angle of the bucket when the distance between the work equipment and the control reference is less than the bucket control start threshold is kept constant or such that an angle of the bucket in relation to the target construction line is kept constant.

7. A work machine comprising:

work equipment including a bucket; and the work equipment control device according to claim 1.

* * * * *